US011532430B2

(12) United States Patent
Zhai

(10) Patent No.: US 11,532,430 B2
(45) Date of Patent: Dec. 20, 2022

(54) LAMINATED TRANSFORMER-TYPE TRANSMITTER-RECEIVER DEVICE AND METHOD OF FABRICATING SAME

(71) Applicant: SUZHOU QING XIN FANG ELECTRONICS TECHNOLOGY CO., LTD., Suzhou (CN)

(72) Inventor: Jerry Zhijun Zhai, Toronto (CA)

(73) Assignee: SUZHOU QING XIN FANG ELECTRONICS TECHNOLOGY CO., LTD., Suzhou (CN)

( * ) Notice: Subject to any disclaimer, the term of this patent is extended or adjusted under 35 U.S.C. 154(b) by 369 days.

(21) Appl. No.: 16/905,107

(22) Filed: Jun. 18, 2020

(65) Prior Publication Data

US 2020/0402709 A1 Dec. 24, 2020

Related U.S. Application Data

(60) Provisional application No. 62/864,162, filed on Jun. 20, 2019.

(51) Int. Cl.
*H01F 27/36* (2006.01)
*H01F 27/28* (2006.01)

(52) U.S. Cl.
CPC ..... *H01F 27/36* (2013.01); *H01F 27/2804* (2013.01); *H01F 2027/2809* (2013.01)

(58) Field of Classification Search
CPC ..... H01F 27/36; H01F 27/2804; H01F 2027/2809
USPC ..... 336/84 R
See application file for complete search history.

(56) References Cited

U.S. PATENT DOCUMENTS 8,089,331 B2 * 1/2012 Jacobson ..... H01F 27/2804 336/200
8,531,261 B2 * 9/2013 Pache ..... H01F 27/2804 336/84 R
9,218,903 B2 * 12/2015 Sun ..... H01L 23/645
9,589,718 B2 * 3/2017 Yang ..... H01F 27/363

* cited by examiner

*Primary Examiner* — Alfonso Perez Borroto
(74) *Attorney, Agent, or Firm* — BainwoodHuang

(57) ABSTRACT

A laminated transformer-type transmitter-receiver device for transmitting or delivering electrical signals and/or power. The laminated device can include two metal shielding layers disposed between transmit and receive windings, which, in turn, are disposed between two magnetic layers. The laminated device further includes a dielectric isolation layer disposed between the two metal shielding layers. In the laminated device, no (or very little) common mode capacitance is distributed within the dielectric isolation layer, and no (or very little) common mode or "leakage" current flows across the dielectric isolation layer. As a result, various adverse effects of the common mode capacitance and the leakage current during operation of the laminated device are avoided.

20 Claims, 13 Drawing Sheets

*Fig. 1 – Prior art*

LAMINATED TRANSFORMER-TYPE TRANSMITTER-RECEIVER DEVICE AND METHOD OF FABRICATING SAME

CROSS REFERENCE TO RELATED APPLICATIONS

This application claims benefit of the priority of U.S. Provisional Patent Application No. 62/864,162 filed Jun. 20, 2019 entitled LAMINATED TRANSFORMER-TYPE TRANSMITTER-RECEIVER DEVICE AND METHOD OF FABRICATING SAME.

TECHNICAL FIELD

The present disclosure relates to a laminated transformer-type transmitter-receiver device for transmitting or delivering electrical signals and/or power, in which the common mode capacitance and the common mode or "leakage" current across an isolation barrier of the device are reduced or eliminated.

BACKGROUND

A conventional transformer-type transmitter-receiver device includes, on a transmit side of the device, a transmit winding coupleable to a transmit driver, and, on a receive side of the device, a receive winding coupleable to a receive circuit. The transmit side and the receive side are electrically isolated from one another by an isolation barrier. During operation of the conventional device, a carrier signal source connected to the transmit driver causes a current to flow through the transmit winding at a carrier frequency, which typically ranges from several megahertz (MHz) to several hundred MHz. Due to magnetic coupling between the transmit winding and the receive winding, a current is caused to flow through the receive winding at the carrier frequency. The current flowing through the receive winding is fed to the receive circuit for generating an electrical signal and/or power output. Such conventional devices have been used in electrical/electronic devices or systems such as isolated universal serial bus (USB) devices, isolated RS232 devices, isolated RS485 devices, isolated peripheral component interconnect (PCI) devices, isolated universal serial bus-power delivery (USB-PD) devices, controller area network (CAN) devices, isolated switching power supplies, voltage level shifters in motor drivers, multi-cell battery voltage monitors, renewable energy systems, power factor correction devices, voltage level shifters in high voltage devices implemented using insulated gate bipolar transistor (IGBT) devices, metal oxide semiconductor field effect transistor (MOSFET) devices, gallium nitride (GaN) devices, silicon carbide (SiC) devices, and so on.

SUMMARY

In the conventional transformer-type transmitter-receiver device described herein, the transmit winding and the receive winding each contribute to a parasitic capacitance (also referred to herein as the "common mode capacitance"), which is distributed throughout the isolation barrier separating the respective windings. When a voltage is applied between the transmit side and the receive side of the conventional device, the distributed capacitance provides a path for a parasitic current (also referred to herein as the "common mode current" or "leakage current") to flow across the isolation barrier between the transmit side and the receive side.

Unfortunately, the leakage current can adversely affect the electrical and/or safety characteristics of electrical/electronic devices or systems in which the conventional device is employed. For example, high leakage currents can cause safety problems associated with the use of such electrical/electronic devices or systems. Further, the leakage current can cause power losses in the fundamental frequency and higher-order harmonic frequencies of the signal and/or power outputs generated by the conventional device. In certain high performance devices or systems (such as those used in the medical field), the leakage current may be required to be lower than about 5 microamperes (μA) to satisfy safety standards promulgated by Underwriters Laboratories, Inc. (UL), Canadian Standards Association (CSA), Verband Deutscher Electroechnischer e.V. (VDE), Guojia Biaozhun (GB), and/or any other suitable national or international standards organization. In addition, the leakage current can adversely affect the signal transmission integrity, limit the signal transmission speed, and/or reduce the reliability or lifetime of the isolation barrier of the conventional device.

Moreover, the common mode capacitance can adversely affect the electrical characteristics of the electrical/electronic devices or systems in which the conventional device is employed. For example, the common mode capacitance can have a detrimental effect on the common mode transient immunity (CMTI) of such electrical/electronic devices or systems. The CMTI of a device or system is an important parameter when operating the device or system at high switching frequencies. In certain high performance devices or systems, the CMTI may be required to be higher than about 300 kilovolts (kV)/microsecond (μs). The common mode capacitance can also cause common mode electromagnetic interference (EMI) from the fundamental frequency to higher-order harmonic frequencies (e.g., up to several gigahertz (GHz) or higher) of the signal and/or power outputs generated by the conventional device. In addition, in certain high performance devices or systems, the coupling coefficient magnetically linking the transmit winding and the receive winding of the conventional device may be increased to enhance transmitting efficiency. However, such an increase in the magnetic coupling can, in turn, increase the common mode capacitance, particularly in integrated transformer-type transmitter-receiver devices. Further, as the common mode capacitance increases, the leakage current in the conventional device is also increased.

A laminated transformer-type transmitter-receiver device is disclosed herein for transmitting or delivering electrical signals and/or power, in which the common mode capacitance and the common mode or leakage current across an isolation barrier of the disclosed device are reduced or eliminated. The disclosed device has a multi-layered laminate structure that includes, on a transmit side of the device, a first magnetic layer, one or more first conductor layers for implementing a transmit winding, and a first metal shielding layer adjacent the first conductor layers of the transmit winding; and, on a receive side of the device, a second metal shielding layer, one or more second conductor layers for implementing a receive winding adjacent the second metal shielding layer, and a second magnetic layer. The multi-layered laminate structure further includes a dielectric isolation layer disposed or sandwiched between the first metal shielding layer and the second metal shielding layer, and a metal input/output (TO) layer disposed adjacent the first magnetic layer on the transmit side of the device. The transmit winding is coupleable to a transmit driver, and the receive winding is coupleable to a receive circuit. Further, the first metal shielding layer is directly connected to ground on the transmit side, and the second metal shielding layer is directly connected to ground on the receive side.

During operation of the disclosed device, a carrier signal source connected to the transmit driver can cause a current to flow through the transmit winding at a carrier frequency. Further, the magnetic coupling between the transmit winding and the receive winding can cause a current to flow through the receive winding at the carrier frequency. The current flowing through the receive winding is fed to the receive circuit for generating an electrical signal and/or power output. During each cycle of the carrier frequency, a voltage potential is distributed along the conductor layers of the transmit winding, and a corresponding voltage potential is distributed along the conductor layers of the receive winding. Further, the transmit winding contributes to a parasitic capacitance distributed throughout the adjacent first metal shielding layer, and the receive winding contributes to a parasitic capacitance distributed throughout the adjacent second metal shielding layer.

However, in the disclosed device, no common mode capacitance is distributed within the dielectric isolation layer. Further, because the first metal shielding layer on the transmit side and the second metal shielding layer on the receive side are electrically grounded, no electric field is created between the respective metal shielding layers. As a result, no common mode current or leakage current flows across the dielectric isolation layer between the transmit side and the receive side of the device. Rather, a first differential mode current flows through the first metal shielding layer to ground on the transmit side, while a second differential mode current flows through the second metal shielding layer to ground on the receive side. Because, in the disclosed device, no common mode capacitance is distributed within the dielectric isolation layer, and no leakage current flows across the dielectric isolation layer, various adverse effects of the common mode capacitance and/or the leakage current are avoided.

According to a first aspect of the present disclosure, a transformer-type transmitter-receiver device includes, on a transmit side of the device, a first magnetic layer, a first metal shielding layer, and at least one first conductor layer disposed between the first magnetic layer and the first metal shielding layer, in which the first conductor layer has a transmit winding formed thereon. The transformer-type transmitter-receiver device further includes, on a receive side of the device, a second metal shielding layer, a second magnetic layer, and at least one second conductor layer disposed between the second metal shielding layer and the second magnetic layer, in which the second conductor layer has a receive winding formed thereon. The transformer-type transmitter-receiver device still further includes a dielectric isolation layer disposed between the first metal shielding layer and the second metal shielding layer.

In some embodiments, the first metal shielding layer is electrically grounded on the transmit side of the device, and the second metal shielding layer is electrically grounded on the receive side of the device.

According to a second aspect of the present disclosure, a method of fabricating a transformer-type transmitter-receiver device, includes, on a transmit side of the device, disposing at least one first conductor layer adjacent a first metal shielding layer, the first conductor layer having a transmit winding formed thereon, and disposing a first magnetic layer adjacent the first conductor layer. The method further includes, on a receive side of the device, disposing at least one second conductor layer adjacent a second magnetic layer, the second conductor layer having a receive winding formed thereon, and disposing a second metal shielding layer adjacent the second conductor layer. The method still further includes disposing a dielectric isolation layer between the first metal shielding layer and the second metal shielding layer.

In some embodiments, the method further includes electrically grounding the first metal shielding layer on the transmit side of the device, and electrically grounding the second metal shielding layer on the receive side of the device.

Other features, functions, and aspects of the present disclosure will be evident from the Detailed Description that follows.

BRIEF DESCRIPTION OF THE DRAWINGS

The foregoing and other objects, features, and advantages will be apparent from the following description of particular embodiments of the present disclosure, as illustrated in the accompanying drawings, in which like reference characters refer to the same parts throughout the different views.

DETAILED DESCRIPTION

The disclosure of U.S. Provisional Patent Application No. 62/864,162 filed Jun. 20, 2019 entitled LAMINATED TRANSFORMER-TYPE TRANSMITTER-RECEIVER DEVICE AND METHOD OF FABRICATING SAME is hereby incorporated herein by reference in its entirety.

A laminated transformer-type transmitter-receiver device is disclosed herein for transmitting or delivering electrical signals and/or power. The laminated device can include two metal shielding layers disposed between transmit and receive windings, which, in turn, are disposed between two magnetic layers. The laminated device further includes a dielectric isolation layer disposed between the two metal shielding layers. In the laminated device, no common mode capacitance is distributed within the dielectric isolation layer, and no common mode or "leakage" current flows across the dielectric isolation layer. As a result, various adverse effects of the common mode capacitance and/or the leakage current during operation of the laminated device are avoided.

Figure 1:
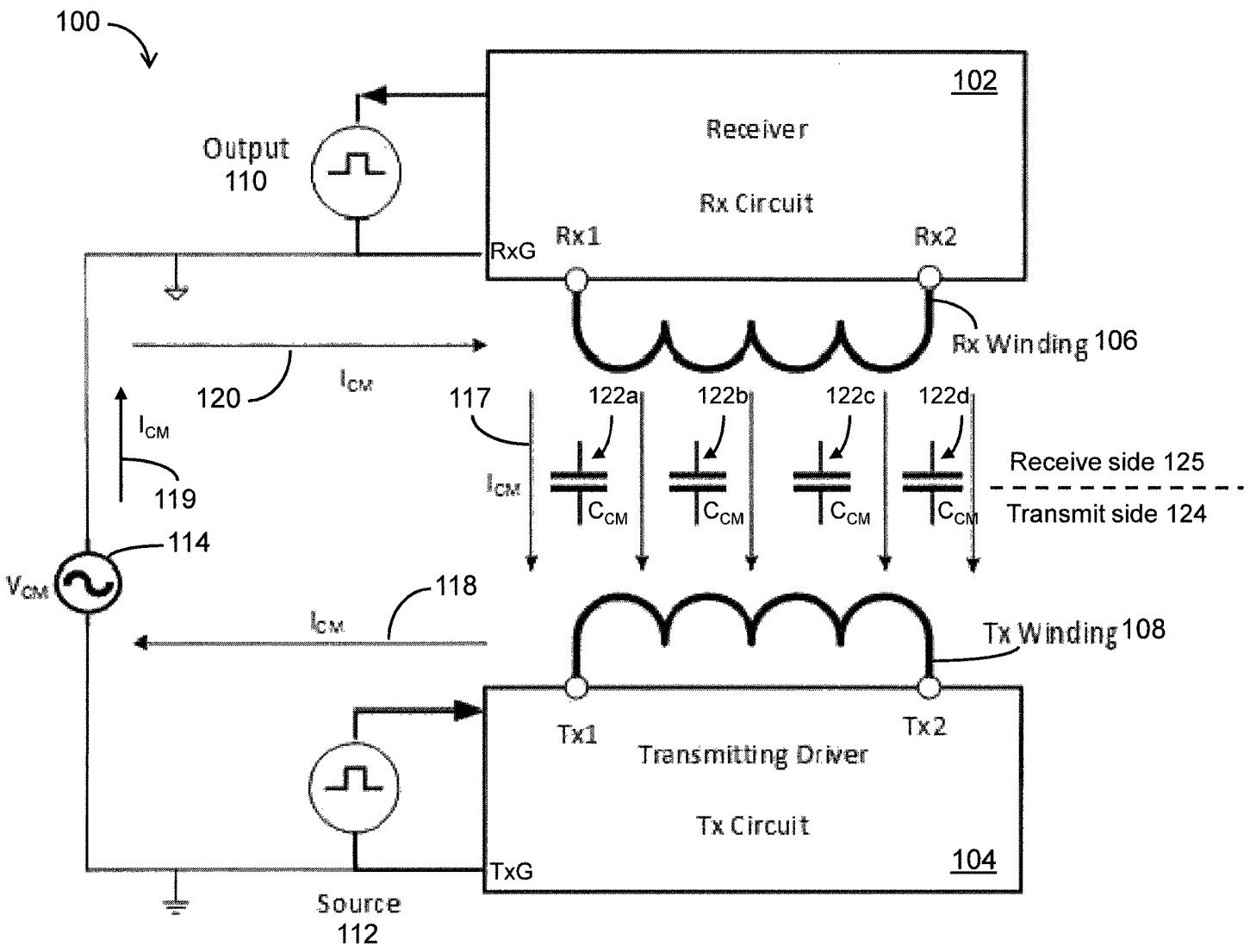
FIG. 1 is a schematic diagram of a conventional transformer-type transmitter-receiver device for transmitting or delivering an electrical signal and/or power.

FIG. 1 depicts a conventional transformer-type transmitter-receiver device 100 for transmitting or delivering an electrical signal and/or power. As shown in FIG. 1, the conventional device 100 includes, on a transmit side 124, a transmit winding 108 coupled to a transmit driver 104 through pads or connections Tx1, Tx2; and, on a receive side 125, a receive winding 106 coupled to a receive circuit 102 through pads or connections Rx1, Rx2. The transmit side 124 and the receive side 125 are electrically isolated from one another by an isolation barrier (not shown). During operation of the conventional device 100, a carrier signal source 112 connected to the transmit driver 104 causes a current to flow through the transmit winding 108 at a carrier frequency, which typically ranges from several megahertz (MHz) to several hundred MHz. Due to magnetic coupling between the transmit winding 108 and the receive winding 106, a current is caused to flow through the receive winding 106 at the carrier frequency. The current flowing through the receive winding 106 is fed to the receive circuit 102 for generating an electrical signal and/or power output 110.

In the conventional device 100 of FIG. 1, the transmit winding 108 and the receive winding 106 each contribute to a parasitic capacitance (also referred to herein as the "inter-winding capacitance," "common mode capacitance," or "$C_{CM}$"), which is distributed throughout the isolation barrier separating the respective windings 106, 108. As shown in FIG. 1, the distributed capacitance is illustrated by a plurality of common mode capacitances $C_{CM}$ 122*a*, 122*b*, 122*c*, 122*d*. When a voltage 114 (illustrated in FIG. 1 as a common mode voltage, $V_{CM}$) is applied between the transmit side 124 and the receive side 125 of the conventional device 100, the distributed capacitance 122*a*, 122*b*, 122*c*, 122*d* provides a path 117 for a parasitic current (also referred to herein as the "common mode current," "leakage current," or "$I_{CM}$") to flow across the isolation barrier from the receive side 125 to the transmit side 124, and to return from the transmit side 124 to the receive side 125 along paths 118, 119, 120. For example, such a common mode voltage, $V_{CM}$, can be applied between the transmit and receive sides 124, 125 during a dielectric voltage-withstand test. However, the common mode capacitance, $C_{CM}$, and the leakage current, $I_{CM}$, can adversely affect various electrical and/or safety characteristics of electrical/electronic devices or systems in which the conventional device 100 is employed.

Figure 2:
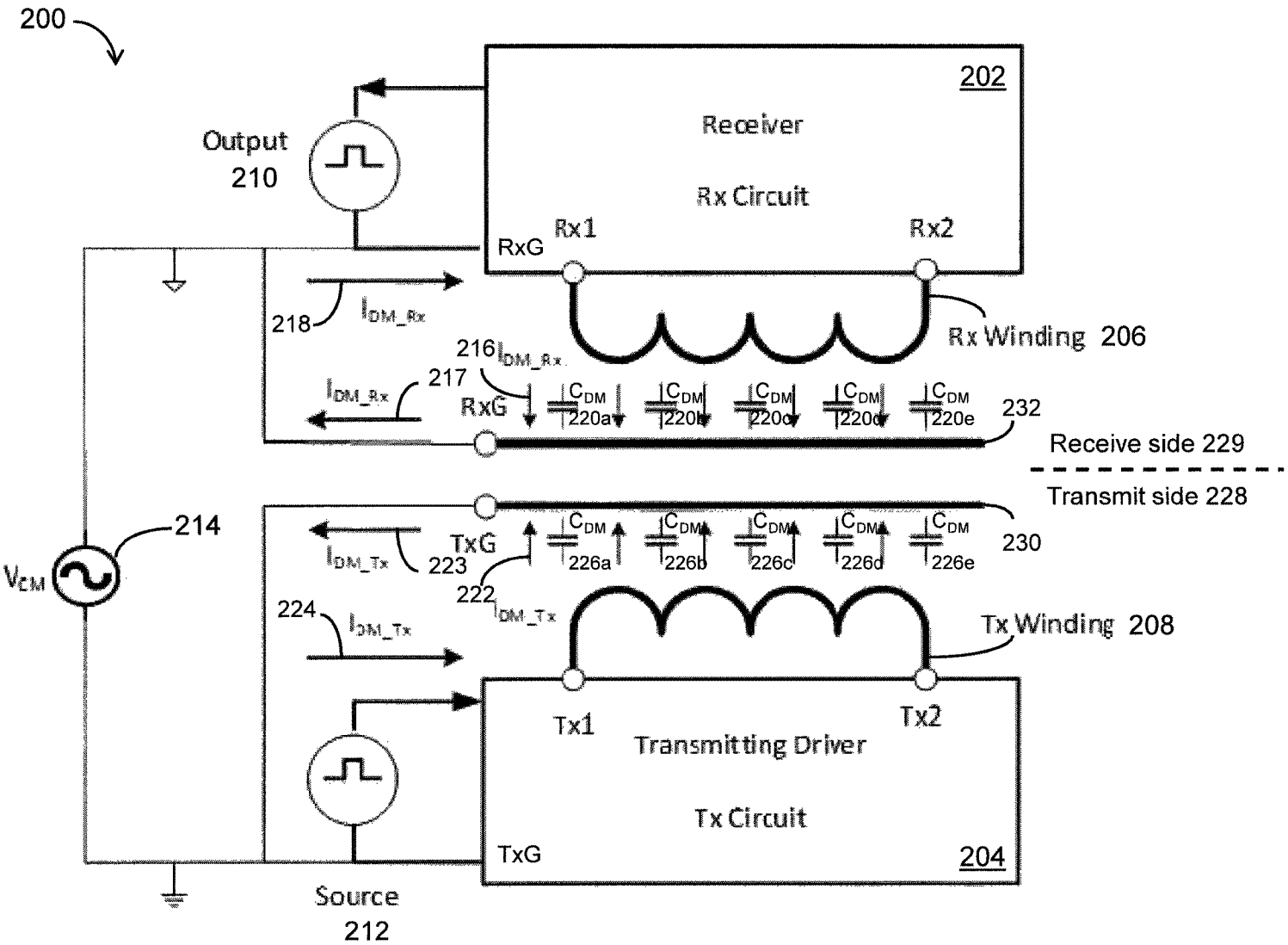
FIG. 2 is a schematic diagram of an exemplary transformer-type transmitter-receiver device for transmitting or delivering an electrical signal and/or power, in accordance with the present disclosure.

FIG. 2 depicts an illustrative embodiment of an exemplary transformer-type transmitter-receiver device 200 for transmitting or delivering an electrical signal and/or power, in accordance with the present disclosure. In the disclosed device 200, the common mode capacitance, $C_{CM}$, and the common mode or leakage current, $I_{CM}$, across an isolation barrier (not shown) of the device are reduced or eliminated. As shown in FIG. 2, the disclosed device 200 includes, on a transmit side 228, a transmit winding 208 coupled to a transmit driver 204, and a first metal shield 230 adjacent the transmit winding 208; and, on a receive side 229, a receive winding 206 coupled to a receive circuit 202, and a second metal shield 232 adjacent the receive winding 206. The first metal shield 230 on the transmit side 228 is directly connected to ground of the transmit driver 204, and the second metal shield 232 on the receive side 229 is directly connected to ground of the receive circuit 202. It is noted that, in the disclosed device 200, the physical location of the transmit side can be exchanged with the physical location of the receive side 229. In other words, the transmitting functionality of the disclosed device 200 can be considered to be bidirectional.

During operation of the disclosed device 200, a carrier signal source 212 connected to the transmit driver 204 can cause a current to flow through the transmit winding 208 at a carrier frequency. Further, the magnetic coupling between the transmit winding 208 and the receive winding 206 can cause a current to flow through the receive winding 206 at the carrier frequency. The current flowing through the receive winding 206 is fed to the receive circuit 202 for generating an electrical signal and/or power output 210. During each cycle of the carrier frequency, a voltage potential is distributed along the transmit winding 208, and, due to the coupling between the transmit and receive windings 208, 206, a corresponding voltage potential is distributed along the receive winding 206. The transmit winding 208 contributes to a parasitic capacitance (also referred to herein as the "differential mode capacitance" or "$C_{DM}$") distributed throughout the adjacent first metal shield 230, and the receive winding 206 contributes to another differential mode capacitance, $C_{DM}$, distributed throughout the adjacent second metal shield 232.

As shown in FIG. 2, the differential mode capacitance, $C_{DM}$, distributed throughout the first metal shield 230 is illustrated by a plurality of differential mode capacitances $C_{DM}$ 226*a*, 226*b*, 226*c*, 226*d*, 226*e*. Similarly, the differential mode capacitance, $C_{DM}$, distributed throughout the second metal shield 232 is illustrated by another plurality of differential capacitances $C_{DM}$ 220*a*, 220*b*, 220*c*, 220*d*, 220*e*. When a voltage 214 (illustrated in FIG. 2 as a common mode voltage, $V_{CM}$) is applied between the transmit side 228 and the receive side 229 of the disclosed device 200, the distributed capacitance 226*a*, 226*b*, 226*c*, 226*d*, 226*e* provides a path 222 for a parasitic current (also referred to herein as the "differential mode transmit current" or "$I_{DM_Tx}$") to flow from the transmit winding 208 to the first metal shield 230, and to return from the first metal shield 230 to the transmit driver 204 along paths 223, 224 through the ground of the transmit driver 204. Similarly, the distributed capacitance 220*a*, 220*b*, 220*c*, 220*d*, 220*e* provides a path 216 for a parasitic current (also referred to herein as the "differential mode receive current" or "$I_{DM_Rx}$") to flow from the receive winding 206 to the second metal shield 232, and to return from the second metal shield 232 to the receive circuit 202 along paths 217, 218 through the ground of the receive circuit 202. For example, such a common mode voltage, $V_{CM}$, can be applied between the transmit and receive sides 228, 229 during a dielectric voltage-withstand test.

Accordingly, in the disclosed device 200, no (or very little) common mode capacitance, $C_{CM}$, is distributed within the isolation barrier between the transmit side 228 and the receive side 229 of the device. Further, because the first metal shield 230 on the transmit side 228 and the second metal shield 232 on the receive side 229 are electrically grounded, no (or very little) electric field is created between the respective metal shields 230, 232. As a result, no (or very little) common mode or leakage current, $I_{CM}$, flows across the isolation barrier. Rather, when the common mode voltage 214 ($V_{CM}$) is applied between the transmit side 228 and the receive side 229, the differential mode transmit current, $I_{DM_Tx}$, flows through the first metal shield 230 to the ground of the transmit driver 204, and the differential mode receive current, $I_{DM_Rx}$, flows through the second metal shield 232 to the ground of the receive driver 202. Because, in the disclosed device 200, no (or very little) common mode capacitance, $C_{CM}$, is distributed within the isolation barrier, and no (or very little) common mode or leakage current, $I_{CM}$, flows across the isolation barrier, the various adverse effects of the common mode capacitance, $C_{CM}$, and the common mode or leakage current, $I_{CM}$, are avoided.

Figure 3A:
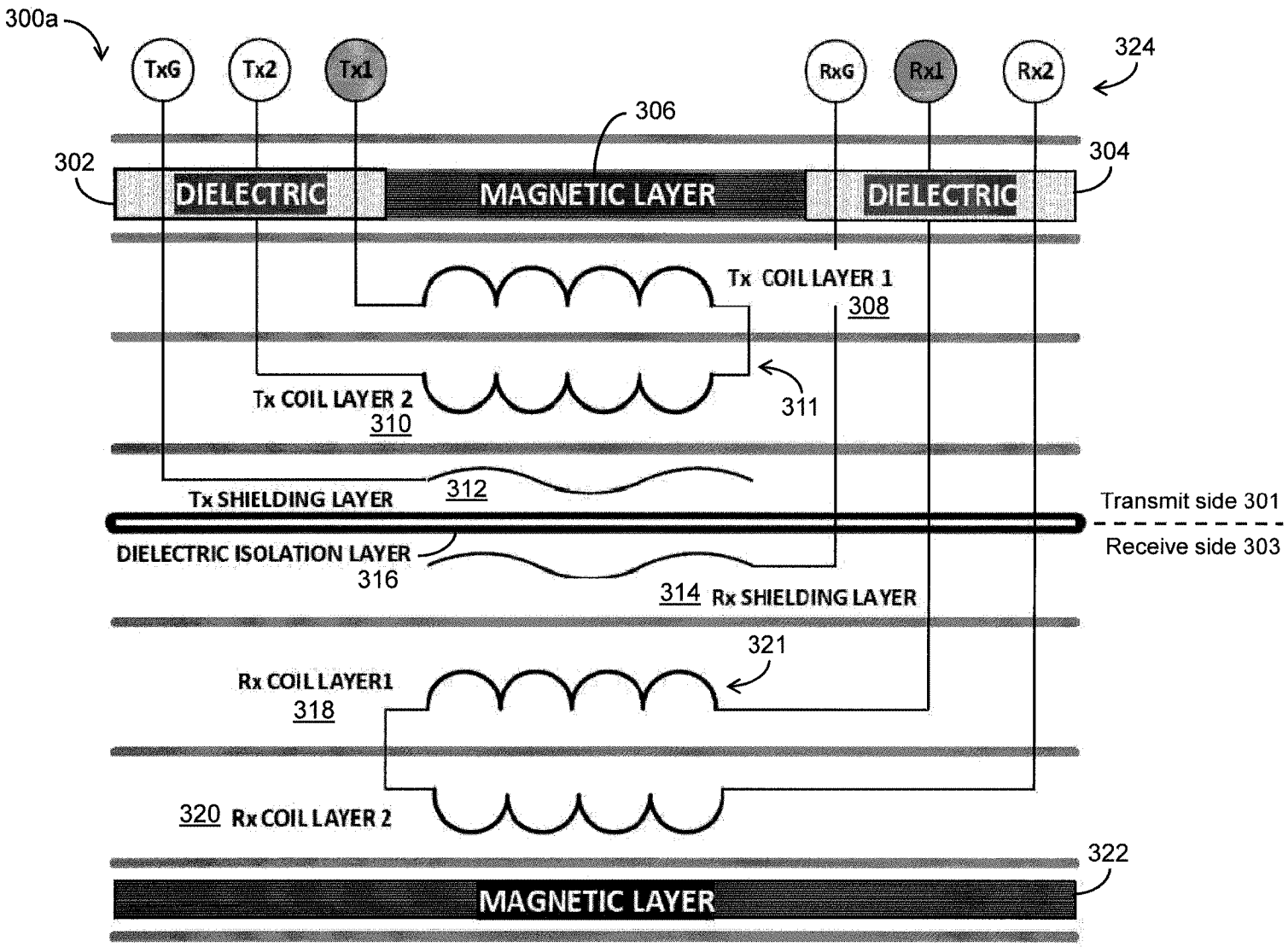
FIG. 3*a* is a cross-sectional view of a layer structure of the transformer-type transmitter-receiver device of FIG. 2.

FIG. 3*a* depicts a cross-sectional view of a layer structure 300*a* of the disclosed device 200 (see FIG. 2). As shown in FIG. 3*a*, the layer structure 300*a* includes, on a transmit side 301, a first magnetic layer 306, a first conductor layer 308 and a second conductor layer 310 for implementing a transmit winding 311, and a first metal shielding layer 312; and, on a receive side 303, a second metal shielding layer 314, a first conductor layer 318 and a second conductor layer 320 for implementing a receive winding 321, and a second magnetic layer 322. The layer structure 300*a* further includes a dielectric isolation layer 316 disposed or sandwiched between the first metal shielding layer 312 and the second metal shielding layer 314, and a metal input/output (IO) layer 324 disposed adjacent the first magnetic layer 306 on the transmit side 301. The transmit winding 311 is coupleable to the transmit driver 204 (see FIG. 2) through pads or connections Tx1, Tx2 formed in the metal IO layer 324, and the receive winding 321 is coupleable to the receive circuit 202 (see FIG. 2) through pads or connections Rx1, Rx2 formed in the metal IO layer 324. Further, the first metal shielding layer 312 is directly connected to the ground of the transmit driver 204 through a pad or connection, TxG, formed in the metal IO layer 324, and the second metal shielding layer 314 is directly connected to the ground of the receive circuit 202 through a pad or connection, RxG, formed in the metal IO layer 324. It is noted that the transmit winding 311 is coupled to the connections, Tx1, Tx2, and the first metal shielding layer 312 is coupled to the connection, TxG, through dielectric material 302 disposed in a cutout region 305 (see FIG. 3*i*) of the first magnetic layer 306. Likewise, the receive winding 321 is coupled to the connections, Rx1, Rx2, and the second metal shielding layer 314 is coupled to the connection, RxG, through dielectric material 304 disposed in a cutout region 307 (see FIG. 3*i*) of the first magnetic layer 306.

Figure 3B:
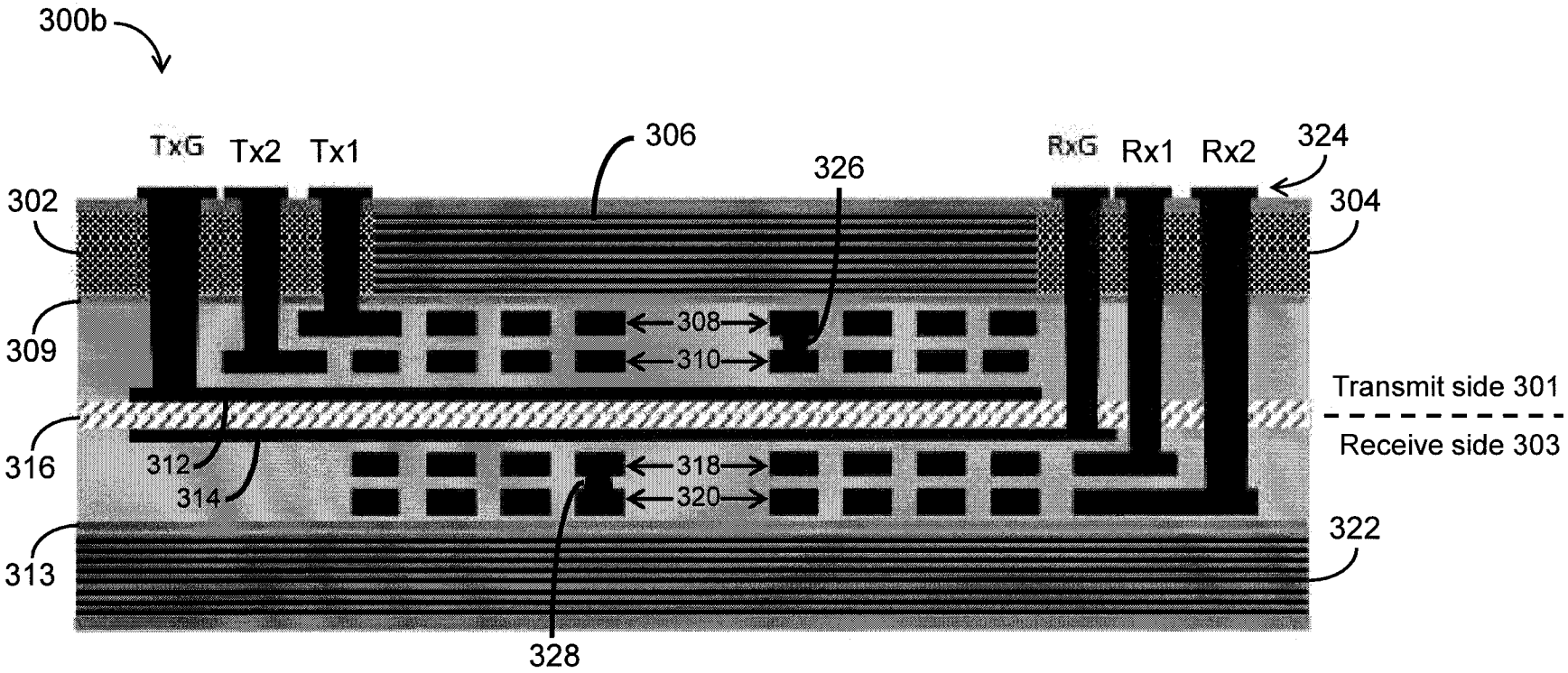
FIG. 3*b* is a cross-sectional view of a laminated device incorporating the layer structure of FIG. 3*a;*

FIG. 3*b* depicts a cross-sectional view of a laminated device 300*b* incorporating the layer structure 300*a* of FIG. 3*a*. As shown in FIG. 3*b*, the laminated device 300*b* includes, on the transmit side 301, the first magnetic layer 306, the first conductor layer 308, the second conductor layer 310, and the first metal shielding layer 312; and, on the receive side 303, the second metal shielding layer 314, the first conductor layer 318, the second conductor layer 320, and the second magnetic layer 322. A first portion 311.1 (see FIG. 3*c*) of the transmit winding 311 in the first conductor layer 308 is connected to a second portion 311.2 (see FIG. 3*d*) of the transmit winding 311 in the second conductor layer 310 by an electrically conductive via 326. Further, a thin layer of dielectric material (not numbered) is disposed or sandwiched between the first conductor layer 308 and the second conductor layer 310. Similarly, a first portion 321.1 (see FIG. 3*e*) of the receive winding 321 in the first conductor layer 318 is connected to a second portion 321.2 (see FIG. 3*f*) of the receive winding 321 in the second conductor layer 320 by an electrically conductive via 328. Further, a thin layer of dielectric material (not numbered) is disposed or sandwiched between the first conductor layer 318 and the second conductor layer 320. The laminated device 300*b* further includes the dielectric isolation layer 316 disposed or sandwiched between the first metal shielding layer 312 and the second metal shielding layer 314, as well as the metal IO layer 324 disposed adjacent the first magnetic layer 306.

It is noted that the dielectric isolation layer 316 between the first and second metal shielding layers 312, 314 is configured to have a high voltage withstand capability to provide sufficient voltage isolation between the transmit side 301 and the receive side 303 of the laminated device 300*b*. The dielectric isolation layer 316 can be implemented using one or more layers of dielectric material to provide sufficient voltage withstand capability in the event of a fault condition involving a single dielectric layer, as may be required by Underwriters Laboratories, Inc. (UL), Canadian Standards Association (CSA), Verband Deutscher Electroechnischer e.V. (VDE), Guojia Biaozhun (GB), and/or any other suitable national or international standards organization. The dielectric isolation layer 316 can be formed using a polyimide film or sheet, a modified polyimide film or sheet, an epoxy film or sheet, a bismaleimide-triazine (BT) film or sheet, or any other suitable dielectric material that provides a high voltage withstand capability. Further, the thickness of the dielectric isolation layer 316 can range from about 10 microns (or micrometers, μm) to 100 μm to withstand up to 10 kV RMS voltage.

With reference to FIGS. 2 and 3*b*-3*d*, the first portion 311.1 of the transmit winding 311 in the first conductor layer 308 is coupleable to the transmit driver 204 through the connection, Tx1, in the metal IO layer 324, and the second portion 311.2 of the transmit winding 311 in the second conductor layer 310 is coupleable to the transmit driver 204 through the connection, Tx2, in the metal IO layer 324. Further, with reference to FIGS. 2, 3*b*, 3*e*, and 3*f*, the first portion 321.1 of the receive winding 321 in the first conductor layer 318 is coupleable to the receive circuit 202 through the connection, Rx1, in the metal IO layer 324, and the second portion 321.2 of the receive winding 321 in the second conductor layer 320 is coupleable to the receive circuit 202 through the connection, Rx2, in the metal IO layer 324. The first metal shielding layer 312 is directly connected to the ground of the transmit driver 204 through the connection, TxG, in the metal IO layer 324, and the second metal shielding layer 314 is directly connected to the ground of the receive circuit 202 through the connection, RxG, in the metal IO layer 324.

As described herein with reference to FIG. 3*a*, the transmit winding 311 is coupled to the connections, Tx1, Tx2, and the first metal shielding layer 312 is coupled to the connection, TxG, through the dielectric material 302. Likewise, the receive winding 321 is coupled to the connections, Rx1, Rx2, and the second metal shielding layer 314 is coupled to the connection, RxG, through the dielectric material 304. Accordingly, with reference to FIGS. 3*b*-3*d*, an electrically conductive via (not numbered) connecting the first portion 311.1 of the transmit winding 311 to the connection, Tx1, an electrically conductive via (not numbered) connecting the second portion 311.2 of the transmit winding 311 to the connection, Tx2, and an electrically conductive via (not numbered) connecting the first metal shielding layer 312 to the connection, TxG, each pass through the dielectric material 302. Likewise, with reference to FIGS. 3*b*, 3*e*, and 3*f*, an electrically conductive via (not numbered) connecting the first portion 321.1 of the receive winding 321 to the connection, Rx1, an electrically conductive via (not numbered) connecting the second portion 321.2 of the receive winding 321 to the connection, Rx2, and an electrically conductive via (not numbered) connecting the second metal shielding layer 314 to the connection, RxG, each pass through the dielectric material 304.

It is noted that internal clearance distances from the respective connections Tx1, Tx2, TxG, Rx1, Rx2, RxG, to the edge of the laminated device outline can be made to conform to the requirements of UL, CSA, VDE, GB, and/or any other suitable national or international standards organization. Likewise, the clearance distance between the group of connections Tx1, Tx2, TxG, and the group of connections Rx1, Rx2, RxG, can be made to conform to the requirements of UL, CSA, VDE, GB, and/or any other suitable national or international standards organization.

Figure 3C:
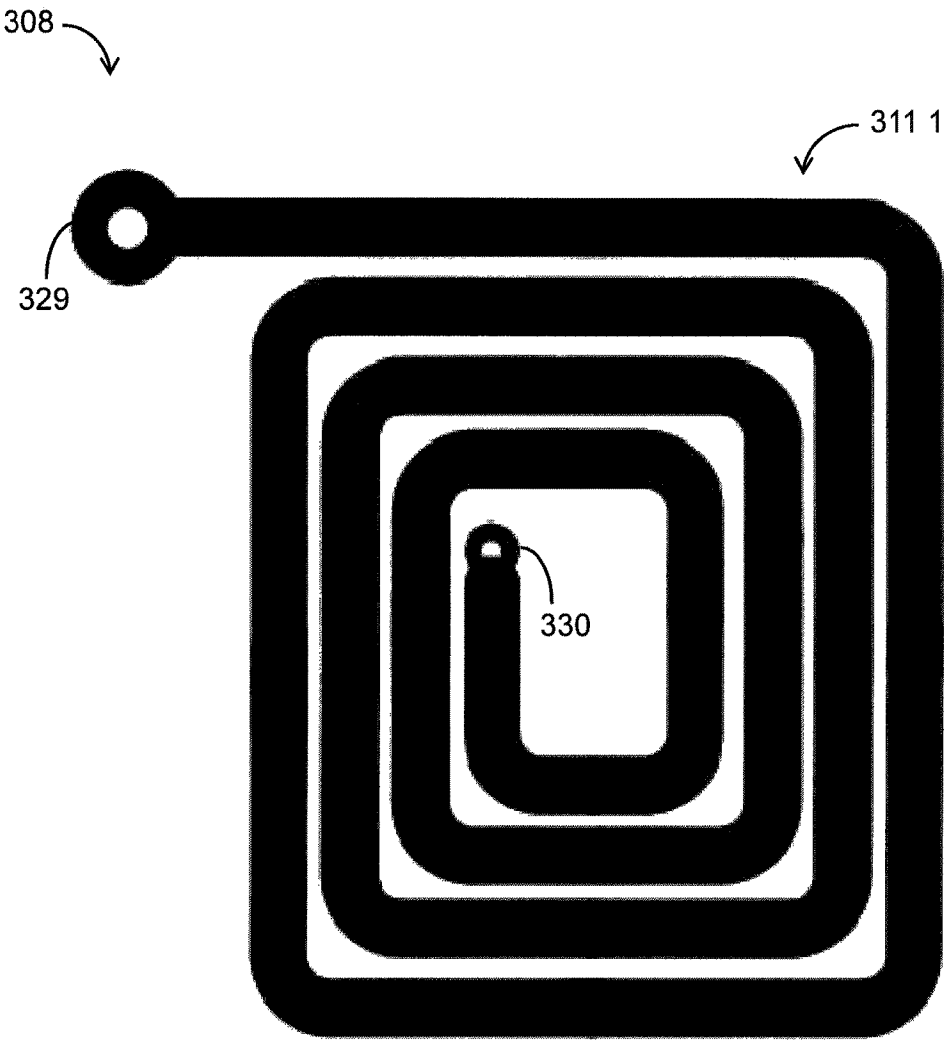
FIG. 3*c* is a plan view of a first portion of a transmit winding included in the laminated device of FIG. 3*b*, in which the first portion of the transmit winding is formed in a first conductor layer on a transmit side of the laminated device of FIG. 3*b;*
Figure 3D:
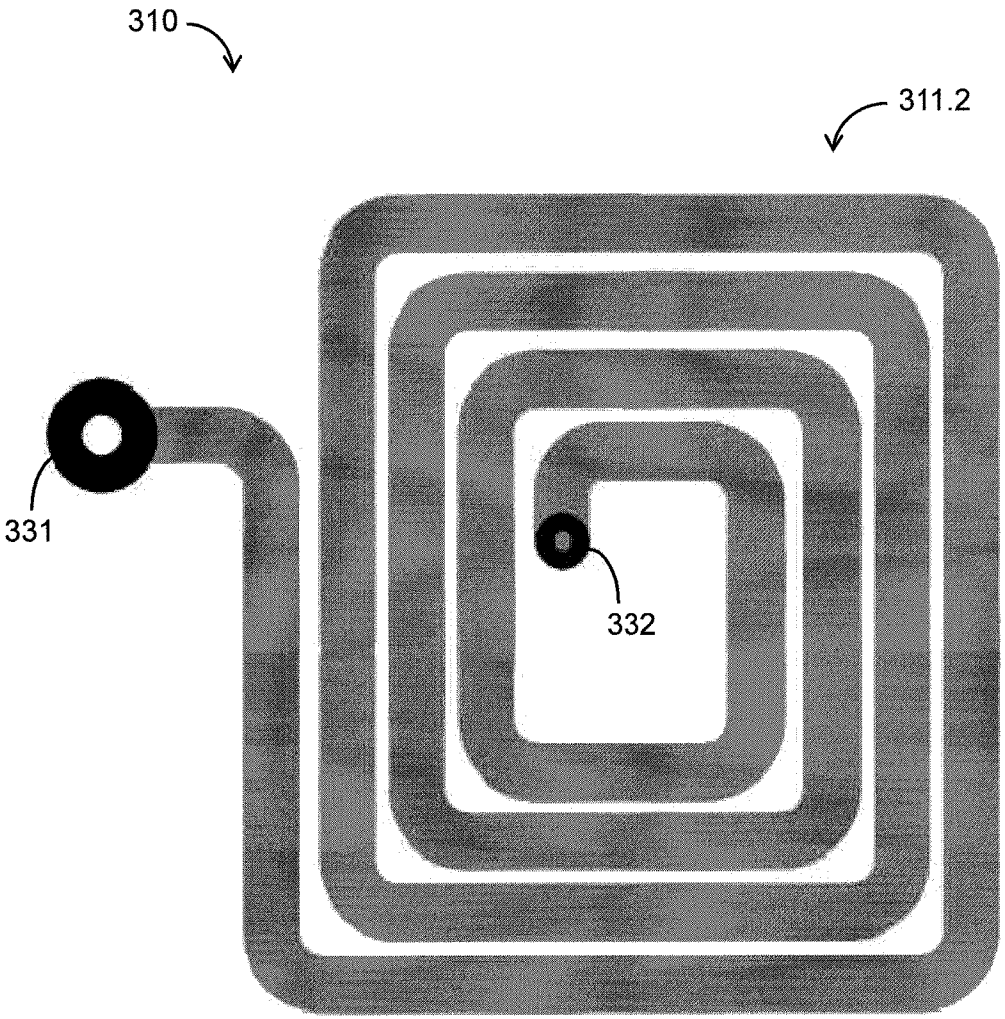
FIG. 3*d* is a plan view of a second portion of the transmit winding of FIG. 3*c*, in which the second portion of the transmit winding is formed in a second conductor layer on the transmit side of the laminated device of FIG. 3*b;*

FIG. 3*c* depicts a plan view of the first portion 311.1 of the transmit winding 311 formed in the first conductor layer 308 on the transmit side 301 of the laminated device 300*b* (see FIG. 3*b*). As shown in FIG. 3*c*, the first portion 311.1 of the transmit winding 311 has a generally spiral shape. Further, the first portion 311.1 of the transmit winding 311 includes a pad 329 for connecting the first portion 311.1 to the connection, Tx1, through the electrically conductive via (not numbered), as well as a pad 330 for connecting the first portion 311.1 to the second portion 311.2 (see FIG. 3*d*) of the transmit winding 311 through the electrically conductive via 326. FIG. 3*d* depicts a plan view of the second portion 311.2 of the transmit winding 311 formed in the second conductor layer 310 on the transmit side 301 of the laminated device 300*b* (see FIG. 3*b*). Like the first portion 311.1 of the transmit winding 311, the second portion 311.2 of the transmit winding 311 has a generally spiral shape. Further, the second portion 311.2 of the transmit winding 311 includes a pad 331 for connecting the second portion 311.2 to the connection, Tx2, through the electrically conductive via (not numbered), as well as a pad 332 for connecting the second portion 311.2 to the first portion 311.1 of the transmit winding 311 through the electrically conductive via 326.

Figure 3E:
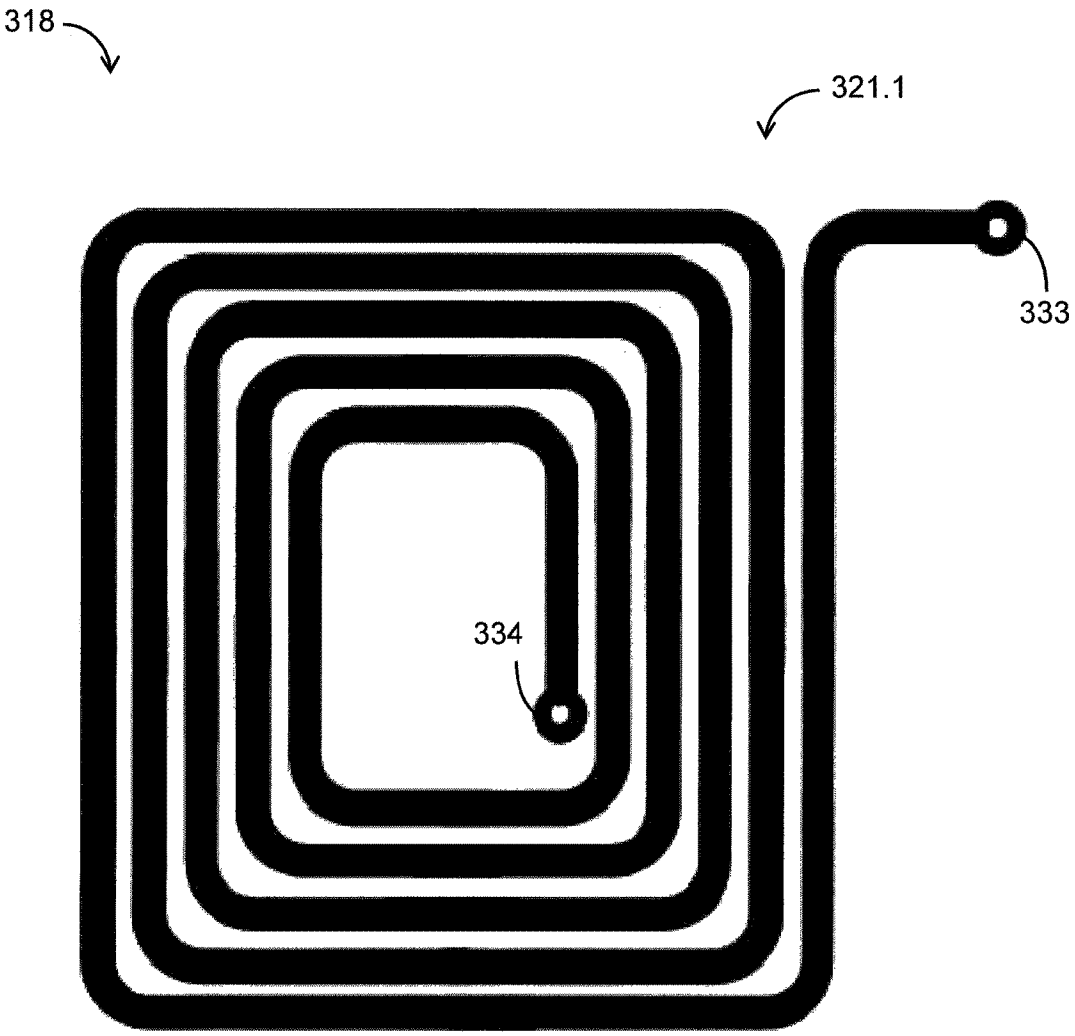
FIG. 3*e* is a plan view of a first portion of a receive winding included in the laminated device of FIG. 3*b*, in which the first portion of the receive winding is formed in a first conductor layer on a receive side of the laminated device of FIG. 3*b;*

FIG. 3*e* depicts a plan view of the first portion 321.1 of the receive winding 321 formed in the first conductor layer 318 on the receive side 303 of the laminated device 300*b* (see FIG. 3*b*). As shown in FIG. 3*e*, the first portion 321.1 of the receive winding 321 has a generally spiral shape. Further, the first portion 321.1 of the receive winding 321 includes a pad 333 for connecting the first portion 321.1 to the connection, Rx1, through the electrically conductive via (not numbered), as well as a pad 334 for connecting the first portion 321.1 to the second portion 321.2 (see FIG. 3*f*) of the receive winding 321 through the electrically conductive via 328.

Figure 3F:
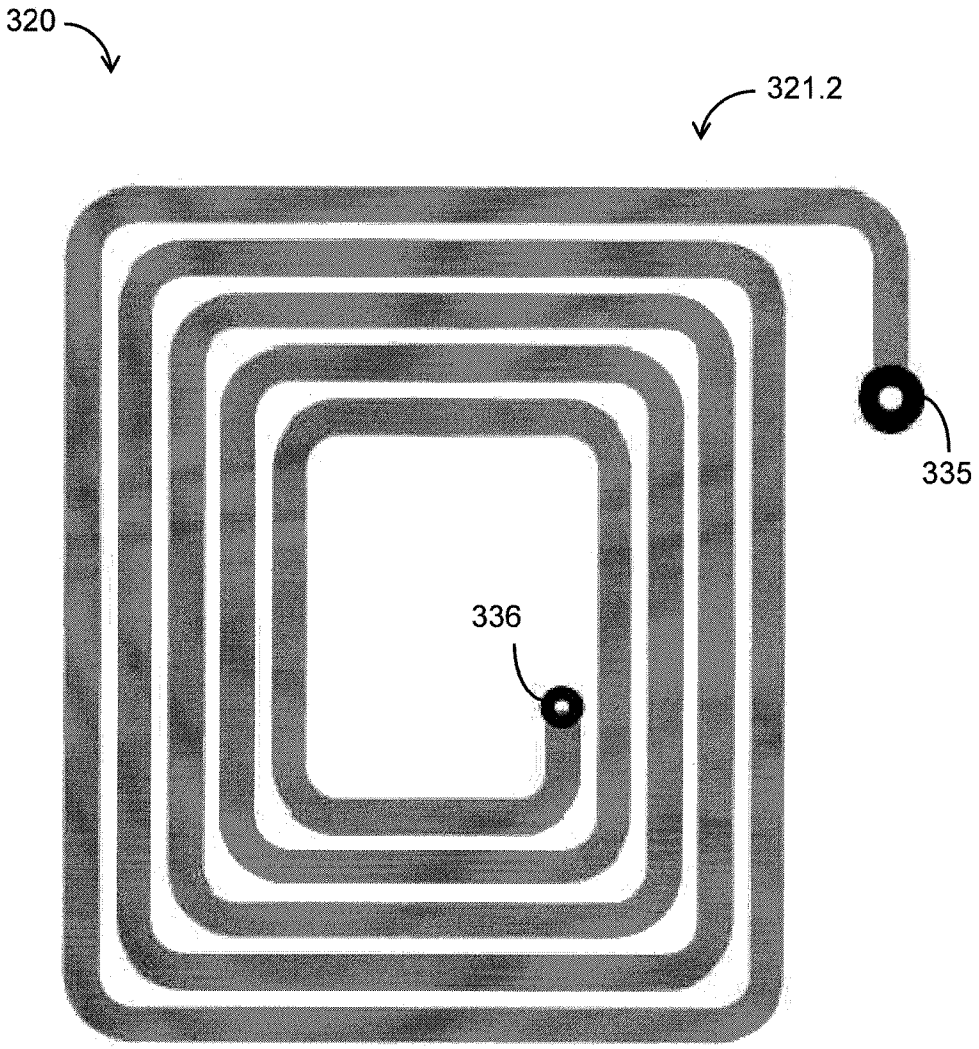
FIG. 3*f* is a plan view of a second portion of the receive winding of FIG. 3*g*, in which the second portion of the receive winding is formed in a second conductor layer on the receive side of the laminated device of FIG. 3*b;*

FIG. 3*f* depicts a plan view of the second portion 321.2 of the receive winding 321 formed in the second conductor layer 320 on the receive side 303 of the laminated device 300*b* (see FIG. 3*b*). Like the first portion 321.1 of the receive winding 321, the second portion 321.2 of the receive winding 321 has a generally spiral shape. Further, the second portion 321.2 of the receive winding 321 includes a pad 335 for connecting the second portion 321.2 to the connection, Rx2, through the electrically conductive via (not numbered), as well as a pad 336 for connecting the second portion 321.2 to the first portion 321.1 of the receive winding 321 through the electrically conductive via 328. It is noted that the first and second portions 321.1, 321.2 of the receive winding 321 can be formed in symmetrical layer positions relative to the first and second portions 311.1, 311.2 of the transmit winding 311.

It is further noted that the first and second conductor layers 308, 310, and the first metal shielding layer 312 on the transmit side 301, as well as the first and second conductor layers 318, 320, and the second metal shielding layer 314 on the receive side 303, can each be fabricated using copper, aluminum, or any other suitable electrically conductive material. Further, the spiral shapes of the first and second portions 311.1, 311.2 of the transmit winding 311 can be fabricated in the first and second conductor layers 308, 310, respectively, using an etching process, an electroplating process, a semi-additive process (SAP), a modified semi-additive process (mSAP), or any other suitable process. Likewise, the spiral shapes of the first and second portions 321.1, 321.2 of the receive winding 321 can be fabricated in the first and second conductor layers 318, 320, respectively, using an etching process, an electroplating process, a SAP, an mSAP, or any other suitable process. Each of the first and second conductor layers 308, 310 on the transmit side 301, and the first and second conductor layers 318, 320 on the receive side 303, can have a thickness ranging from about 3 μm to 100 μm, depending on the transmitting frequency and/or power of the transmit winding 311. Further, the thin layer of dielectric material between the first and second conductor layers 308, 310 on the transmit side 301, and the thin layer of dielectric material between the first and second conductor layers 318, 320 on the receive side 303, can each have a thickness ranging from about 5 μm to 60 μm. Such thin layers of dielectric material can be formed using a polyimide film or sheet, an epoxy film or sheet, a BT film or sheet, or any other suitable material. In addition, internal clearance distances from the electrically conductive vias (not numbered) connected to the connections Tx1, Tx2, TxG, Rx1, Rx2, and RxG, respectively, to the edge of the laminated device outline can be made to conform to the requirements of UL, CSA, VDE, GB, and/or any other suitable national or international standards organization. It is still further noted that the transmit winding 311 and the receive winding 321 can each be configured with the same winding pattern. However, the configurations of the coil turns of the transmit and receive windings 311, 321 can be different, depending on the coil turn ratio of the transmit winding 311 to the receive winding 321. The coil turn ratio can be based on the voltage ratio of the transmit winding 311 to the receive winding 321.

Figure 3G:
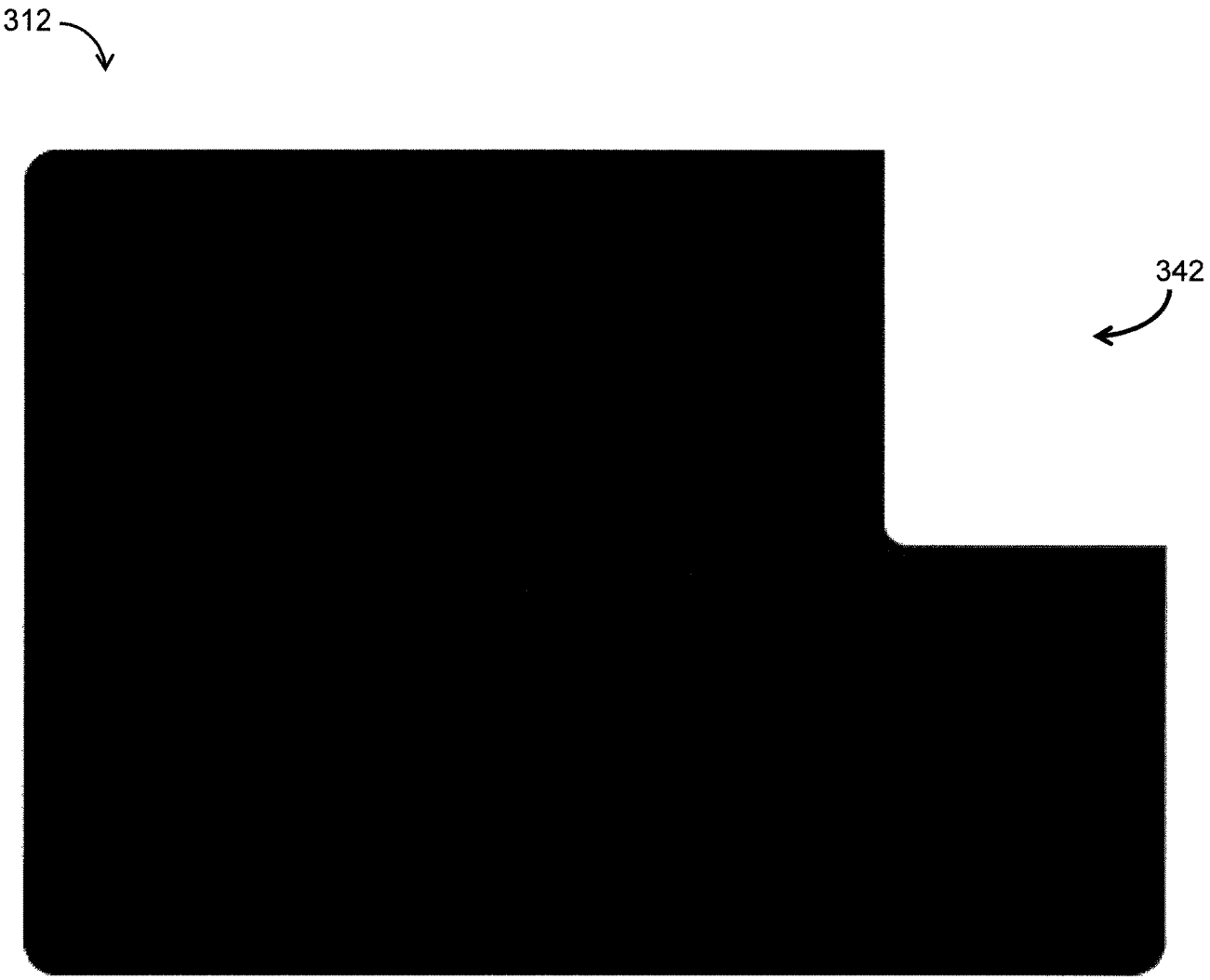
FIG. 3*g* is a plan view of a first metal shielding layer included in the laminated device of FIG. 3*b*, in which the first metal shielding layer is formed on the transmit side of the laminated device of FIG. 3*b;*

FIG. 3*g* depicts a plan view of the first metal shielding layer 312 on the transmit side 301 of the laminated device 300*b* (see FIG. 3*b*). As described herein, the first portion 321.1 of the receive winding 321 is connected to the connection, Rx1, the second portion 321.2 of the receive winding 321 is connected to the connection, Rx2, and the second metal shielding layer 314 is connected to the connection, RxG, through three (3) respective electrically conductive vias (not numbered). To provide these electrically conductive vias access to the connections, Rx1, Rx2, RxG from the receive side 303 of the device, the first metal shielding layer 312 on the transmit side of the device includes a cutout region 342 having a size sufficient to allow the electrically conductive vias to pass therethrough. Further, a bonding film layer or sheet (not numbered) is disposed between the second conductor layer 310 and the first metal shielding layer 312.

It is noted that the first metal shielding layer 312 on the transmit side 301 can have a thickness ranging from about 0.5 μm to 18 μm. Further, internal clearance distances from the electrically conductive vias (not numbered) connected to the respective connections, Rx1, Rx2, RxG, to the first metal shielding layer 312 can be made to conform to the requirements of UL, CSA, VDE, GB, and/or any other suitable national or international standards organization. Likewise, an internal clearance distance from the first metal shielding layer 312 to the edge of the laminated device outline can be made to conform to the requirements of UL, CSA, VDE, GB, and/or any other suitable national or international standards organization.

Figure 3H:
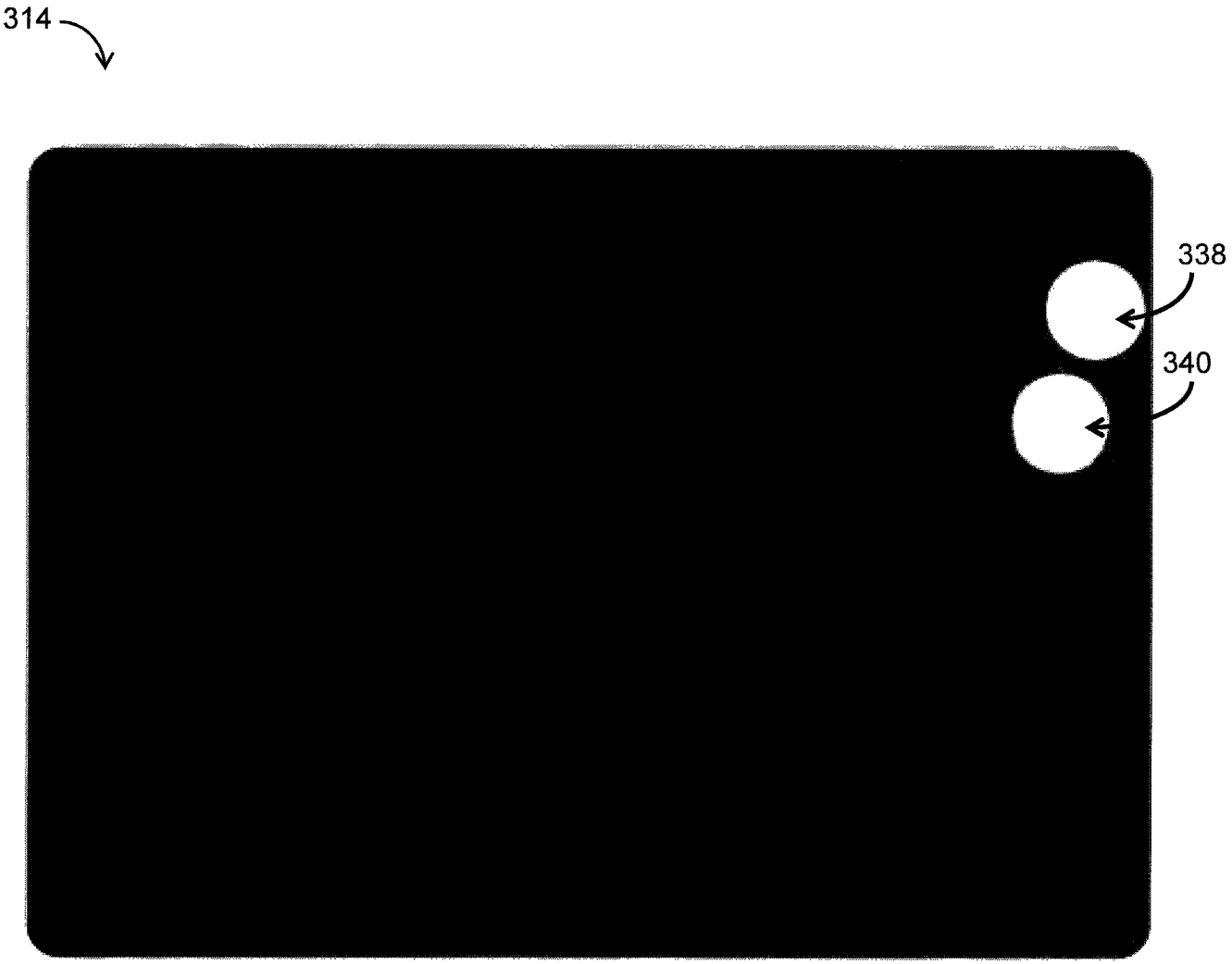
FIG. 3*h* is a plan view of a second metal shielding layer included in the laminated device of FIG. 3*b*, in which the second metal shielding layer is formed on the receive side of the laminated device of FIG. 3*b;*

FIG. 3*h* depicts a plan view of the second metal shielding layer 314 on the receive side 303 of the laminated device 300*b* (see FIG. 3*b*). As described herein, the first portion 321.1 of the receive winding 321 is connected to the connection, Rx1, and the second portion 321.2 of the receive winding 321 is connected to the connection, Rx2, through two (2) respective electrically conductive vias (not numbered). To provide these electrically conductive vias access to the connections, Rx1, Rx2, from the receive side 303 of the device, the second metal shielding layer 314 on the receive side includes two (2) cutout holes or openings 338, 340, each having a size sufficient to allow a respective electrically conductive via to pass therethrough. Further, a bonding film layer or sheet (not numbered) is disposed between the first conductor layer 318 and the second metal shielding layer 314. It is noted that, like the first metal shielding layer 312 on the transmit side 301, the second metal shielding layer 314 on the receive side 303 can have a thickness ranging from about 0.5 μm to 18 μm. Further, an internal clearance distance from the second metal shielding layer 314 to the edge of the laminated device outline can be made to conform to the requirements of UL, CSA, VDE, GB, and/or any other suitable national or international standards organization.

Figure 3I:
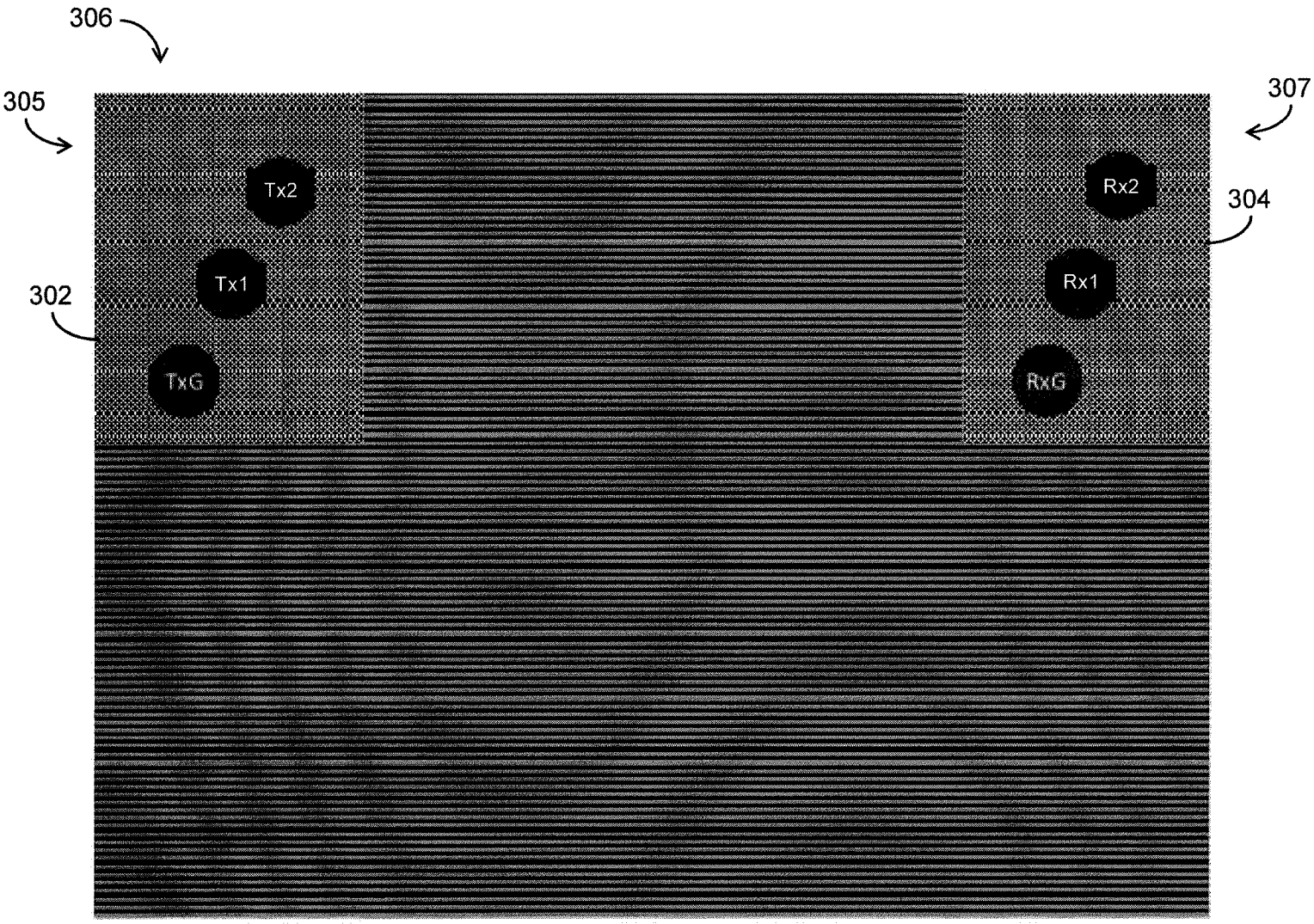
FIG. 3*i* is a plan view of a first magnetic layer on the transmit side of the laminated device of FIG. 3*b;*

FIG. 3*i* depicts a plan view of the first magnetic layer 306 on the transmit side 301 of the laminated device 300*b* (see FIG. 3*b*), as well as the dielectric material 302 and the dielectric material 304 disposed in the cutout region 305 and the cutout region 307, respectively, of the first magnetic layer 306. As described herein, the transmit winding 311 is coupled to the connections, Tx1, Tx2, and the first metal shielding layer 312 is coupled to the connection, TxG, by electrically conductive vias (not numbered) that pass through the dielectric material 302. Likewise, the receive winding 321 is coupled to the connections, Rx1, Rx2, and the second metal shielding layer 314 is coupled to the connection, RxG, by electrically conductive vias (not numbered) that pass through the dielectric material 304. To provide the electrically conductive vias access to the respective connections Tx1, Tx2, TxG, in the metal IO layer 324, the dielectric material 302 includes cutout holes or openings (corresponding to the labels Tx1, Tx2, TxG; see FIG. 3*i*), each having a size sufficient to allow an electrically conductive via to pass therethrough. Similarly, to provide the electrically conductive vias access to the connections Rx1, Rx2, RxG, in the metal IO layer 324, the dielectric material 304 includes cutout holes or openings (corresponding to the labels Rx1, Rx2, RxG; see FIG. 3*i*), each having a size sufficient to allow an electrically conductive via to pass therethrough. The dielectric material 302 and the dielectric material 304 can be a polymer paste such as a polymer of epoxy, or polyimide mixed with dielectric partials (e.g., $SO_2$, glass) to enhance its voltage withstand capability. The dielectric material 302 and the dielectric material 304 can be plugged into the cutout region 305 and the cutout region 307, respectively, and cured. Further, a bonding film layer or sheet 309 (see FIG. 3*b*) is disposed between the first magnetic layer 306 and the first conductor layer 308 on the transmit side 301 of the laminated device 300*b*.

Figure 3J:
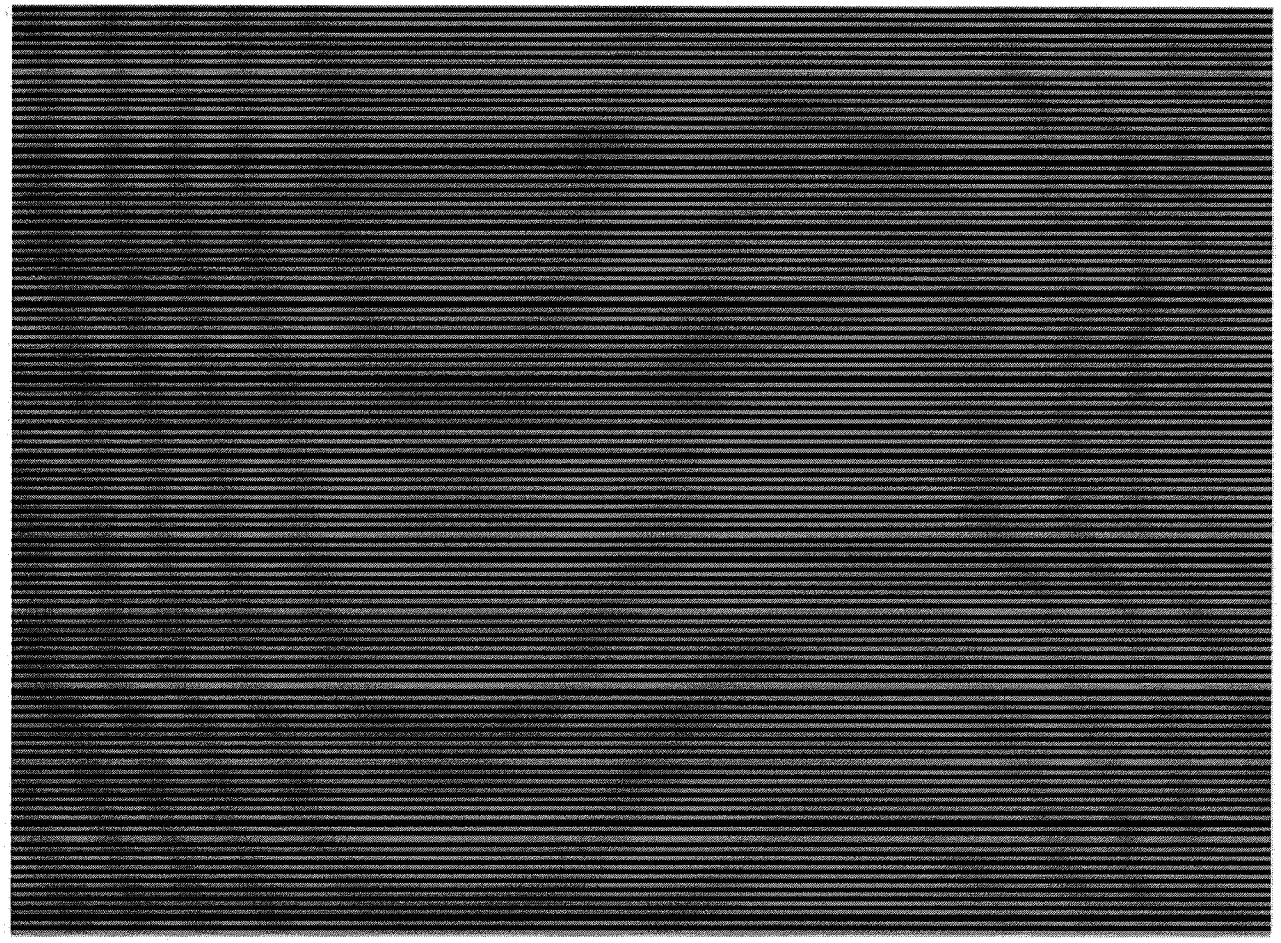
FIG. 3*j* is a plan view of a second magnetic layer on the receive side of the laminated device of FIG. 3*b*.

FIG. 3*j* depicts a plan view of the second magnetic layer 322 on the receive side 303 of the laminated device 300*b* (see FIG. 3*b*). As shown in FIG. 3*j*, the second magnetic layer 322 is a blank magnetic film or sheet with no cutout regions, holes, or openings formed therethrough. The second magnetic layer 322 can therefore be easily bonded to a lead frame in a semiconductor packaging process. Further, a bonding film layer or sheet 313 (see FIG. 3*b*) is disposed between the second magnetic layer 322 and the second conductor layer 320 on the receive side 303.

It is noted that the first magnetic layer 306 and the second magnetic layer 322 can each have a thickness ranging from about 10 μm to 600 μm, and a magnetic permeability ranging from about 50 to 2,000. Further, the laminated device 300*b* can have an overall thickness ranging from about 150 μm to 2 mm. In addition, the bonding film layer or sheet 309, and the bonding film layer or sheet 313, can each be applied by a lamination process having a suitable profile of temperature and pressure under vacuumed conditions.

Figure 4:
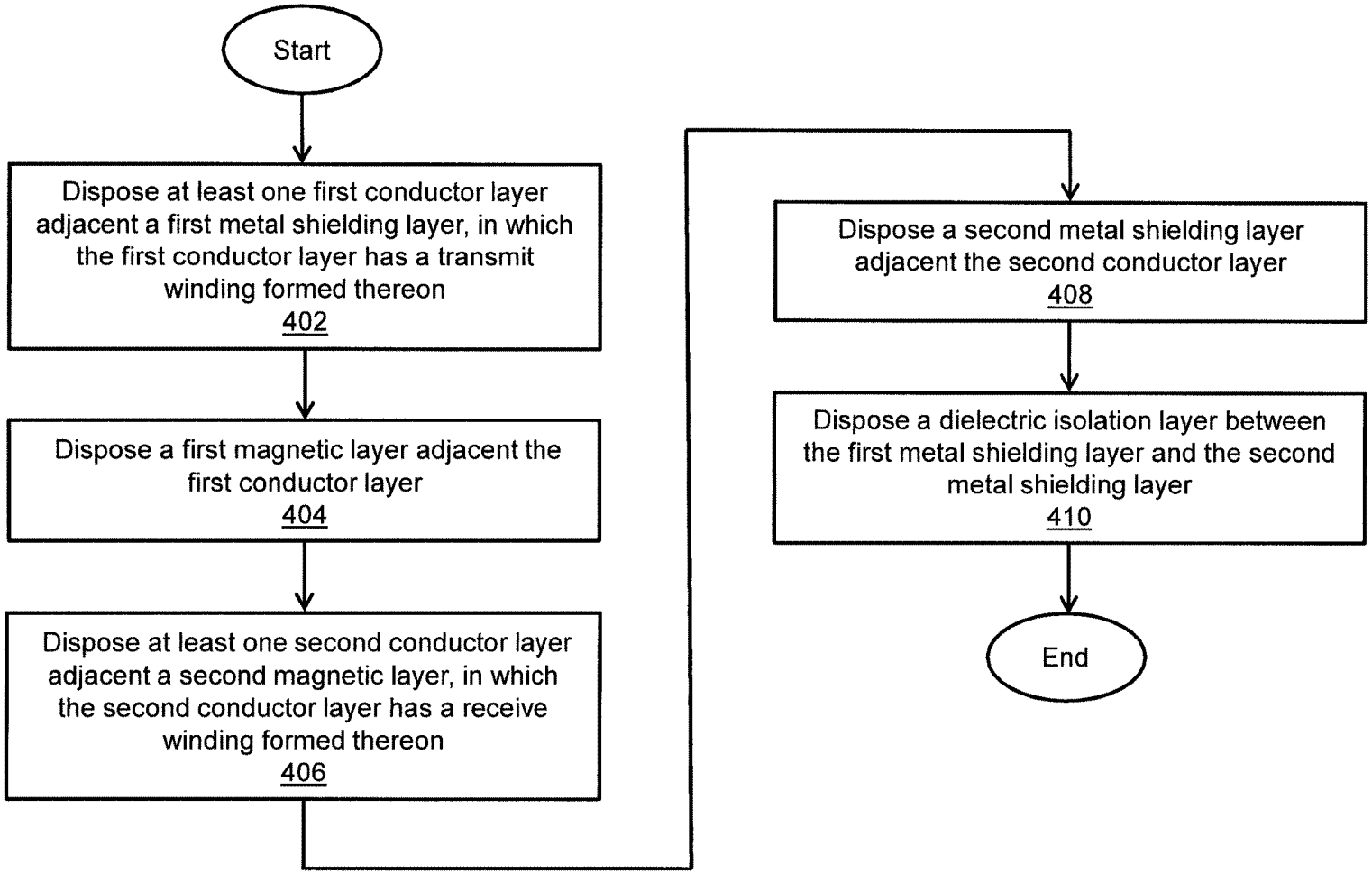
FIG. 4 is a flow diagram of an exemplary method of fabricating the laminated device of FIG. 3*b*.

An exemplary method of fabricating a transformer-type transmitter-receiver device is described below with reference to FIG. 4. As depicted in block 402, at least one first conductor layer is disposed adjacent a first metal shielding layer, in which the first conductor layer has a transmit winding formed thereon. As depicted in block 404, a first magnetic layer is disposed adjacent the first conductor layer. As depicted in block 406, at least one second conductor layer is disposed adjacent a second magnetic layer, in which the second conductor layer has a receive winding formed thereon. As depicted in block 408, a second metal shielding layer is disposed adjacent the second conductor layer. As depicted in block 410, a dielectric isolation layer is disposed between the first metal shielding layer and the second metal shielding layer.

The disclosed transformer-type transmitter-receiver device 300*a* (see FIG. 3*a*) has numerous features and/or advantages. For example, the coupling coefficient magnetically linking the transmit winding 311 and the receive winding 321 can be as high as 90% or more. Further, because the first metal shielding layer 312 and the second metal shielding layer 314 are electrically grounded on the transmit side 301 and the receive side 303, respectively, the transmitting and receiving functionalities of the disclosed device 300*a* do not cause voltage potential changes in the respective metal shielding layers 312, 314. As a result, no (or very little) common mode current, $I_{CM}$, flows between the first metal shielding layer 312 and the second metal shielding layer 314 during operation of the disclosed device 300*a*. Electric field voltage stresses in the dielectric isolation layer 316 are therefore reduced, thereby improving the breakdown voltage, the voltage isolation capability, and/or the voltage isolation lifetime (under common mode voltage bias) of the disclosed device 300*a*.

Moreover, the first and second metal shielding layers 312, 314 have essentially no impact upon the magnetic coupling between the transmit winding 311 and the receive winding 321. Indeed, as noted hereinabove, the coupling coefficient of the disclosed device 300*a* can be as high as 90% or more. Further, because no (or very little) common mode current, $I_{CM}$, flows between the first and second metal shielding layers 312, 314 of the disclosed device 300*a*, electromagnetic interference (EMI) is reduced, and transmitting signal integrity and/or power efficiency are increased. In addition, because the common mode capacitance, $C_{CM}$, across the dielectric isolation layer 316 is reduced or eliminated, the common mode transient immunity (CMTI) of the disclosed device 300*a* can exceed a slew rate of about 1 kV per nanosecond.

While various embodiments of the present disclosure have been particularly shown and described, it will be understood by those skilled in the art that various changes in form and details may be made therein without departing from the scope of the invention as defined by the appended claims.

What is claimed is:

1. A transformer-type transmitter-receiver device, comprising:

on a transmit side of the device:

a first magnetic layer;

a first metal shielding layer; and at least one first conductor layer disposed between the first magnetic layer and the first metal shielding layer, the at least one first conductor layer having a transmit winding formed thereon; and on a receive side of the device:

a second metal shielding layer;

a second magnetic layer; and at least one second conductor layer disposed between the second metal shielding layer and the second magnetic layer, the at least one second conductor layer having a receive winding formed thereon; and a dielectric isolation layer disposed between the first metal shielding layer and the second metal shielding layer.

2. The device of claim 1 wherein a first differential mode capacitance is distributed between the first metal shielding layer and the transmit winding.

3. The device of claim 2 wherein a second differential mode capacitance is distributed between the second metal shielding layer and the receive winding.

4. The device of claim 3 wherein the first metal shielding layer is electrically grounded on the transmit side of the device, and the second metal shielding layer is electrically grounded on the receive side of the device.

5. The device of claim 4 wherein the first metal shielding layer is configured to provide a first path for a differential mode transmit current to flow to ground on the transmit side of the device.

6. The device of claim 5 wherein the second metal shielding layer is configured to provide a second path for a differential mode receive current to flow to ground on the receive side of the device.

7. The device of claim 1 wherein the dielectric isolation layer is configured to provide voltage isolation between the transmit side and the receive side of the device.

8. The device of claim 7 wherein the dielectric isolation layer is formed using one of a polyimide film, a modified polyimide film, an epoxy film, and a bismaleimide-triazine (BT) film.

9. The device of claim 1 wherein the dielectric isolation layer has a thickness ranging from about 10 micrometers (μm) to 100 μm.

10. The device of claim 9 wherein each of the at least one first conductor layer and the at least one second conductor layer has a thickness ranging from about 3 μm to 100 μm.

11. The device of claim 10 wherein each of the first metal shielding layer and the second metal shielding layer has a thickness ranging from about 0.5 μm to 18 μm.

12. The device of claim 11 wherein each of the first magnetic layer and the second magnetic layer has a thickness ranging from about 10 μm to 600 μm.

13. The device of claim 12 wherein the device has an overall thickness ranging from about 150 μm to 2 mm.

14. The device of claim 1 wherein the transmit winding and the receive winding have a magnetic coupling coefficient of at least 0.90.

15. A method of fabricating a transformer-type transmitter-receiver device, comprising:

on a transmit side of the device:

disposing at least one first conductor layer adjacent a first metal shielding layer, the at least one first conductor layer having a transmit winding formed thereon; and disposing a first magnetic layer adjacent the at least one first conductor layer;

on a receive side of the device:

disposing at least one second conductor layer adjacent a second magnetic layer, the at least one second conductor layer having a receive winding formed thereon; and disposing a second metal shielding layer adjacent the at least one second conductor layer; and disposing a dielectric isolation layer between the first metal shielding layer and the second metal shielding layer.

16. The method of claim 15 further comprising:

electrically grounding the first metal shielding layer on the transmit side of the device.

17. The method of claim 16 further comprising:

electrically grounding the second metal shielding layer on the receive side of the device.

18. The method of claim 17 further comprising:

providing a first path for a differential mode transmit current to flow through the first metal shielding layer to ground on the transmit side.

19. The method of claim 18 further comprising:

providing a second path for a differential mode receive current to flow through the second metal shielding layer to ground on the receive side.

20. The method of claim 15 further comprising:

configuring the transmit winding and the receive winding to have a magnetic coupling coefficient of at least 0.90.

* * * * *